US008544895B2

(12) United States Patent
Webb et al.

(10) Patent No.: US 8,544,895 B2
(45) Date of Patent: Oct. 1, 2013

(54) STRIKE DOOR KEEPER ASSEMBLY

(75) Inventors: Michael Allen Webb, Cave Creek, AZ (US); Scott Sullivan, Cave Creek, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 1318 days.

(21) Appl. No.: 12/252,434

(22) Filed: Oct. 16, 2008

(65) Prior Publication Data

US 2010/0096864 A1 Apr. 22, 2010

(51) Int. Cl.
*E05C 5/04* (2006.01)

(52) U.S. Cl.
USPC ..... 292/58; 292/340; 292/201

(58) Field of Classification Search
USPC ..... 292/340, 341.15, 341.16, 201; 70/277, 70/278.7, 279.1
See application file for complete search history.

(56) References Cited

U.S. PATENT DOCUMENTS

| | | | | | |
|---|---|---|---|---|---|
| 3,910,617 | A * | 10/1975 | Scalza et al. | ..... | 292/341.16 |
| 4,015,869 | A * | 4/1977 | Horvath | ..... | 292/341.16 |
| 4,056,277 | A * | 11/1977 | Gamus et al. | ..... | 292/341.16 |
| 4,471,983 | A * | 9/1984 | Bischoff et al. | ..... | 292/341.16 |
| 4,917,425 | A * | 4/1990 | Logas | ..... | 292/341.16 |
| 5,219,196 | A * | 6/1993 | Luker | ..... | 292/341.16 |
| 5,934,720 | A * | 8/1999 | Karalius | ..... | 292/341.16 |
| 6,076,870 | A * | 6/2000 | Frolov | ..... | 292/341.16 |
| 6,082,791 | A * | 7/2000 | Frolov et al. | ..... | 292/341.16 |
| 6,299,225 | B1 * | 10/2001 | Chang | ..... | 292/341.16 |
| 6,595,563 | B2 * | 7/2003 | Kiernan | ..... | 292/341.16 |
| 6,634,685 | B2 * | 10/2003 | Herron et al. | ..... | 292/341.16 |
| 6,874,830 | B2 * | 4/2005 | Bashford | ..... | 292/341.16 |
| 6,886,305 | B2 * | 5/2005 | Ward | ..... | 52/745.15 |
| 6,926,318 | B2 * | 8/2005 | Oxley | ..... | 292/341.16 |
| 7,131,673 | B2 * | 11/2006 | Cherry et al. | ..... | 292/341.16 |
| 7,144,053 | B2 * | 12/2006 | Bashford | ..... | 292/341.16 |
| 7,185,928 | B1 * | 3/2007 | Liao | ..... | 292/341.16 |
| 7,322,621 | B2 * | 1/2008 | Liao | ..... | 292/341.16 |
| 7,472,934 | B2 * | 1/2009 | Burke et al. | ..... | 292/341.16 |
| 7,669,902 | B2 * | 3/2010 | Orbeta | ..... | 292/340 |
| 7,770,949 | B2 * | 8/2010 | Kunda et al. | ..... | 292/341.16 |

* cited by examiner

*Primary Examiner* — Carlos Lugo
*Assistant Examiner* — Mark Williams
(74) *Attorney, Agent, or Firm* — Woods Oviatt Gilman LLP

(57) ABSTRACT

An strike door keeper assembly having first and second bodies matable to form an assembly body, a keeper subassembly disposed within said assembly body, and an actuator member such as an electric solenoid disposed within said assembly body the actuating member terminating in a blocker, wherein said keeper subassembly includes an axle journaled in at least one of said first and second interlocking bodies, a keeper flange pivotable on an axis of said axle and protruding through an opening in one of said first and second interlocking bodies, and a tang extending into interfering relationship with said blocker to fix said keeper flange in a locking position when said solenoid is in one of an energized and a de-energized state. In one aspect of the invention, the assembly includes a faceplate assembly having flanges and keys for mounting and preventing rotation of the door keeper assembly.

11 Claims, 5 Drawing Sheets

STRIKE DOOR KEEPER ASSEMBLY

TECHNICAL FIELD

The present invention relates to electrically-releasable door latch mechanisms, also known in the art as "electric strikes"; more particularly, to electric strike door keepers including a solenoid release element; and most particularly, to an improved electric strike door keeper assembly wherein activation of a solenoid directly unblocks rotation of a latch mechanism, and wherein an improved faceplate for mounting the electric strike sub-assembly eliminates a torque-related shortcoming of prior art electric strike door keeper assemblies.

BACKGROUND OF THE INVENTION

Electric strikes for permitting the release of an otherwise latched door are well known in the art. See, for example, Model 4 K 61, available from Fritz Fuss GmbH & Co., Albstadt, Germany; and Model 3234W-26D, available from Trine Access Technology, Bronx, N.Y. 10461 USA.

In a typical prior art electric strike, a keeper protrudes from a housing and is mechanically maintained in position during closing and consequent locking of a door. A body housing the keeper may be mounted to a faceplate on either the door or the frame to equal effect, although frame mounting is commonly preferred for ease in wiring of the assembly into an entry control system. A manual override may or may not be provided. In use, a complementary latch bolt is provided in either the door or the frame, which engages and interferes with the keeper during opening and closing of the door. Typically, the complementary latch bolt is spring-biased and slidable axially, such that progressive contact with the keeper causes axial depression of the latch bolt to permit passage of the latch bolt past the keeper, whereupon the latch bolt is urged into an opening in the strike or faceplate by the bias spring.

Typically, the keeper is pivotably disposed on a first axis transverse to the direction of door closing and opening and is held in latching mode by a spring-biased arm pivotably disposed on a second axis. The arm engages the keeper, blocking rotation thereof. A solenoid is operable to rotate the arm, either directly or via one or more intermediate levers, pivots, and/or springs.

Prior art electric strikes are complex, having numerous moving parts, and are relatively difficult and time-consuming to assemble. Typically, at least one component requires precision milling and further machining, which adds expense.

What is needed in the art is a simple electric strike door keeper assembly having relatively few components that is inexpensive to manufacture and easy to assemble.

It is a principal object of the present invention to reduce the manufacturing cost of an electric strike door keeper assembly.

SUMMARY OF THE INVENTION

Briefly described, an electric strike door keeper assembly in accordance with the present invention comprises a body formed of first and second body parts that interlock to hold the assembly together. The first body part houses an actuating member such as a linear-acting solenoid having an armature terminating in a blocker. The first and second body parts retain a keeper subassembly comprising a flanged keeper, an axle, and a bias spring. The keeper protrudes through an opening in the second body part, and the axle is captured in journals preferably formed between the first and second body parts by assembly thereof. The spring is biased by assembly of the first and second body parts to cause the keeper to be returned to a locked position. The keeper includes a tang extending into the first body part and engaged by the blocker when the actuating member is in a first position, thus preventing rotation of the keeper in locked mode. When the actuating member is in a second position, as in unlocked mode, the blocker is withdrawn from such engagement, permitting rotation of the keeper. The body parts and keeper may be net formed by casting or other similar inexpensive manufacturing process and thus require no or little finish machining.

In a presently preferred further embodiment, the strike door keeper assembly includes an improved faceplate having a flange extending orthogonally from the plane of the faceplate to eliminate a torque-related shortcoming of prior art strike door keeper assemblies.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate presently preferred embodiments of the invention, and such exemplifications are not to be construed as limiting the scope of the invention in any manner.

DESCRIPTION OF THE PREFERRED EMBODIMENTS

Figure 1:
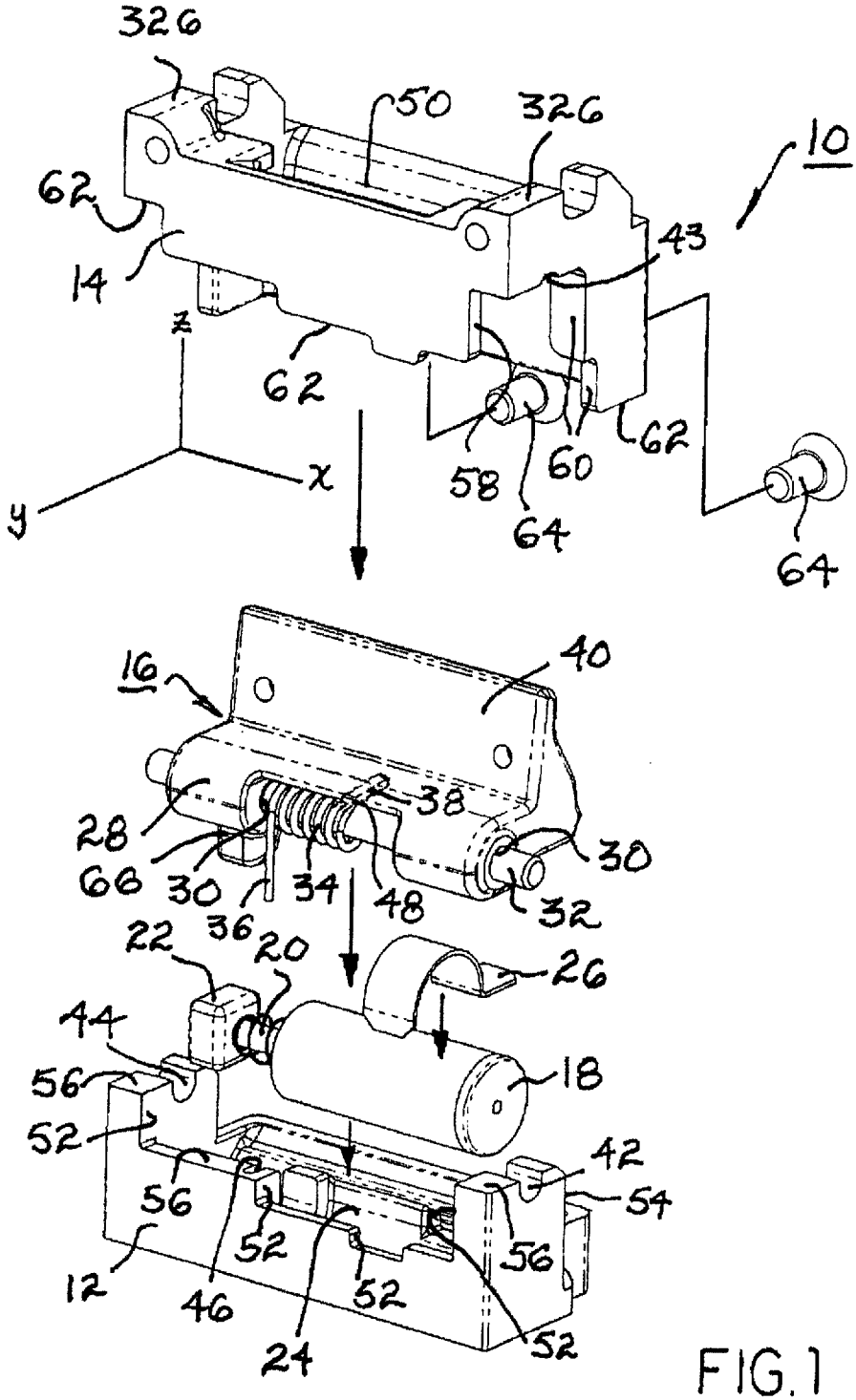
FIG. 1 is an exploded isometric view from the front side of a strike door keeper assembly in accordance with the present invention.
Figure 2:
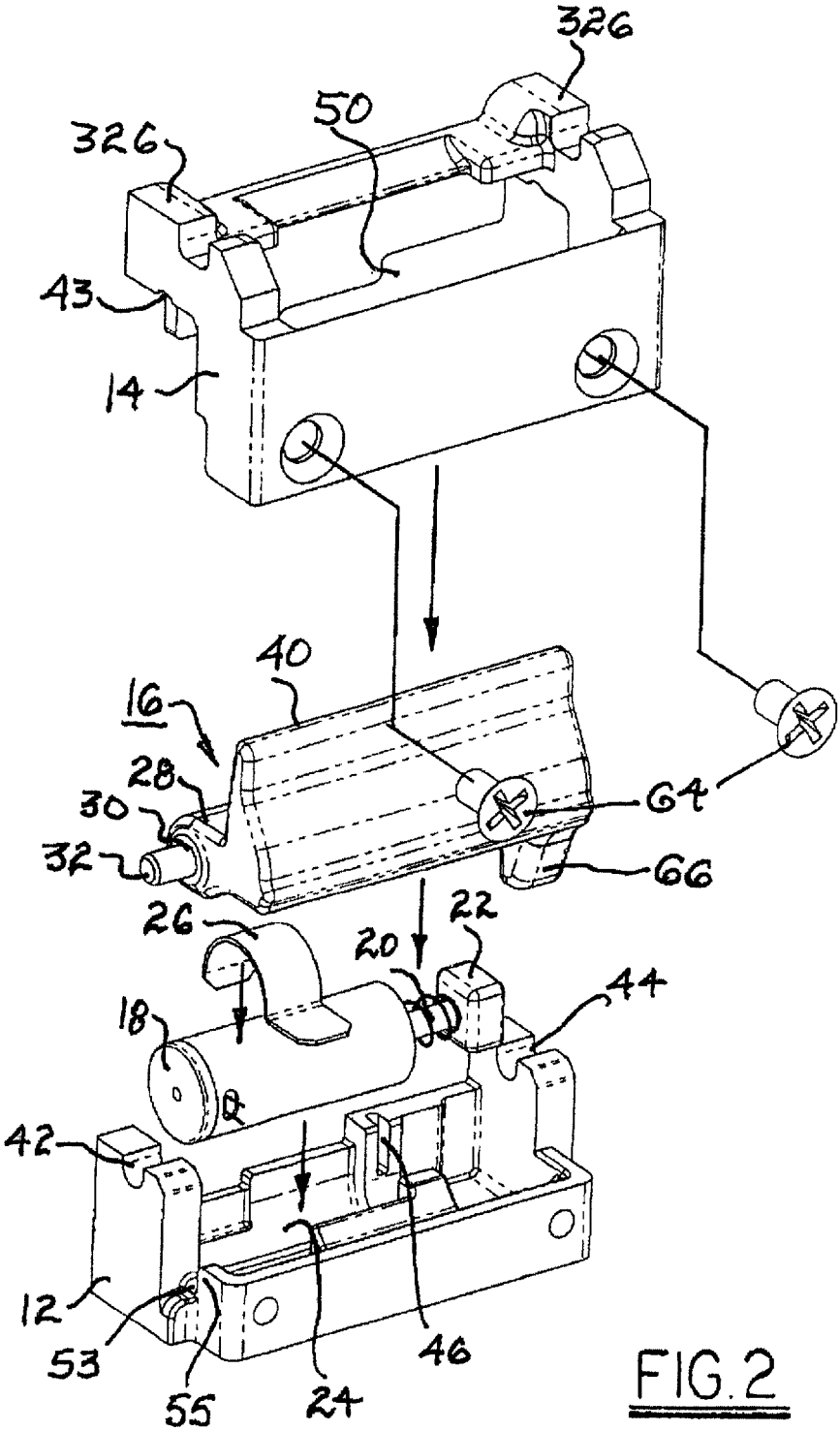
FIG. 2 is an exploded isometric view from the rear side of the strike door keeper assembly shown in FIG. 1.

Referring to FIGS. 1 and 2, an exemplary electric strike door keeper assembly 10 in accordance with the present invention comprises a lower body 12, an upper body 14, and a keeper subassembly 16. An actuating member 18, such as for example, a tubular solenoid, includes an armature 20 terminating in a spring-loaded blocker 22. Solenoid 18 is received in a cradle 24 formed in lower body 12 and preferably is held therein by a clip 26. Keeper subassembly 16 includes a hub region 28 containing throughbores 30 for receiving an axle 32. Alternatively, axle 32 may be formed integral with the hub region as nubs extending axially from the hub region. A biasing spring 34 having first and second tangs 36, 38 is mounted on the hub region such as on axle 32. A keeper flange 40 extends from hub region 28.

In assembly of the electric strike door keeper, solenoid 18 is placed into cradle 24 and secured by clip 26. Keeper subassembly 16 is then positioned adjacent solenoid 18 with axle 32 resting in partial-journal bearings such as lower half-journals 42,44 formed in the upper edge of lower body 12. First spring tang 36 is received in a channel 46 formed in lower body 12, and second spring tang 38 is received in a channel 48 formed within hub 28 such that rotation of keeper subassembly 16 during unlocking acts to store a restoring torque in spring 34. Upper body 14 is placed over keeper subassembly 16, with keeper flange 40 extending through a suitably shaped opening 50 and axle 32 is captured by upper body partial-journal bearing 43 (only one is visible in FIG. 1) so that, when upper body 12 and lower body 14 are joined together, a journal bearing supportive of axle 32 is formed.

As best seen in FIG. 1, x, y and z directions relative to electric door keeper assembly 10 are shown. As indicated in FIG. 1, the x direction is parallel to the axis of rotation of keeper flange 40 about axle 32, each of the y and z directions are perpendicular the x direction, and the y direction is perpendicular to the z direction.

Note that each of lower body 12 and upper body 14 has a plurality of mating surfaces facing in mutually orthogonal (x,y,z) directions; for example, lower body 12 includes mating faces 52,54,56, and upper body 14 includes mating faces 58,62. Further, lower body 12 is provided with a channel 53 defining an ear 55 (FIG. 2) that interlocks in the z direction with a mating ear 60 (FIG. 1) in upper body 14 when the upper and lower bodies are assembled together. Thus, the upper and lower body elements nest together and mutually lock like a jigsaw puzzle against relative motion therebetween in the x and y directions. Solenoid 18 and keeper subassembly 16 are positioned and captured between the upper and lower body elements which are secured together by one or more suitable fasteners such as, for example, screws 64.

Note further that at completion of assembly, blocker 22 within cradle 24 is longitudinally adjacent a locking tang 66 extending from hub region 28, thus preventing rotation of keeper subassembly 16. In this configuration, with solenoid 18 de-energized, electric strike door keeper assembly 10 is in locked mode. When solenoid 18 is energized, armature 20 and blocker 22 are withdrawn axially from rotational interference with locking tang 66, permitting rotation of keeper subassembly 16 in unlocked mode. Thus, keeper subassembly 16 is unlatched and latched directly via the action of solenoid 18 and its integral blocker 22.

Unlike prior art electric strikes, no other components such as additional springs, pivots, levers, and the like are required, and the lower body 12, upper body 14, keeper subassembly 16, and blocker 22 may all be net formed without further or with little finishing such as precision grinding, thus greatly simplifying the assembly of an electric strike, reducing its cost, and improving its reliability.

Figure 3:
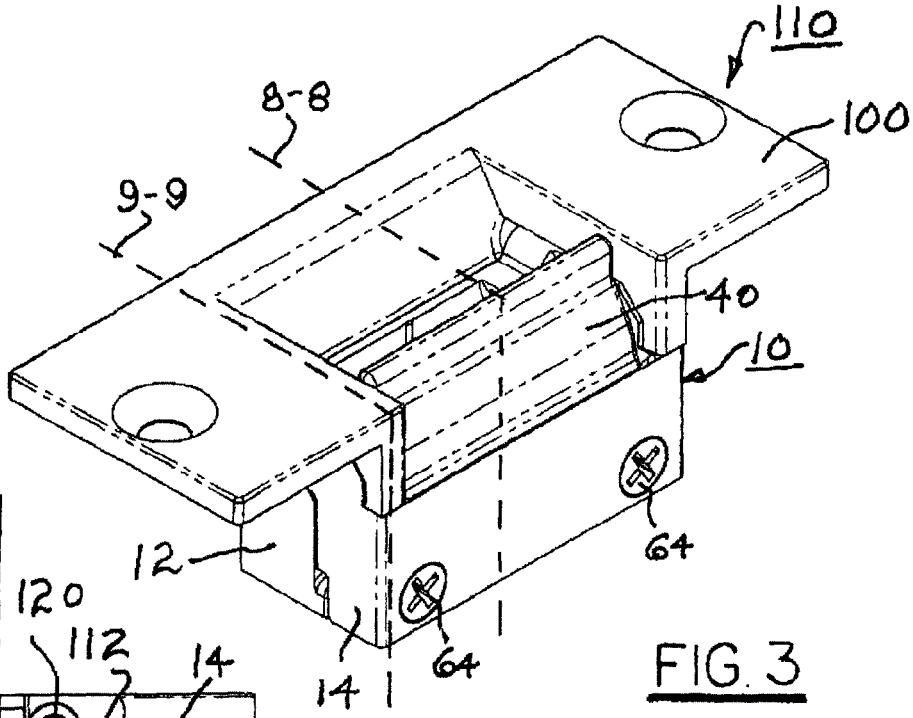
FIG. 3 is an isometric view showing the strike door keeper assembly mounted in a faceplate in accordance with the present invention.
Figure 4:
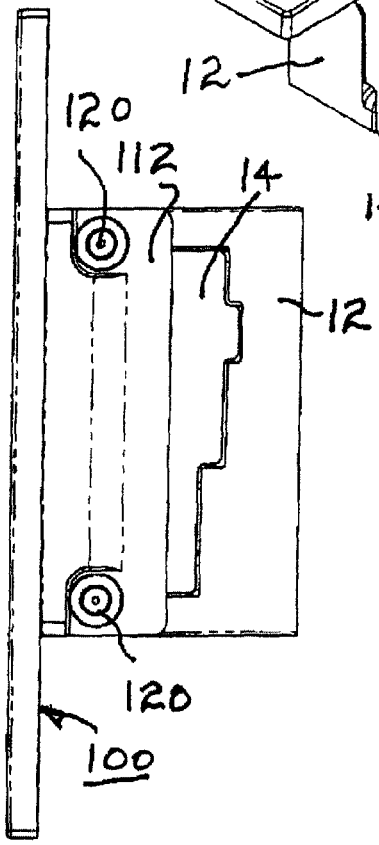
FIG. 4 is a rear view of the assembly shown in FIG. 3.
Figure 5:
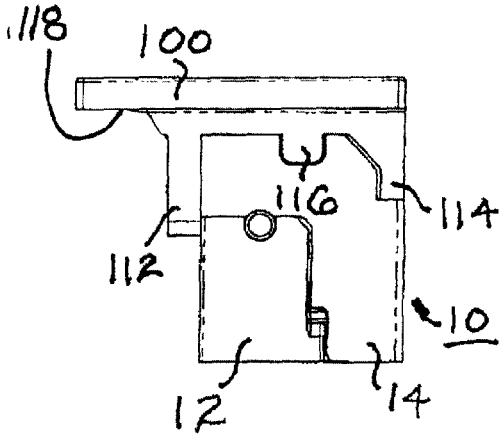
FIG. 5 is an end view of the assembly shown in FIG. 3.

Referring now to FIGS. 3 through 5, an electric strike door keeper assembly 10 in accordance with the present invention is shown mounted to a strike faceplate 100 for a door or jamb to form an integrated electric strike door keeper system 110. Faceplate 100 may be a generic prior art faceplate but preferably is a novel faceplate improved in accordance with the present invention, including longitudinal flanges 112, 114 and keys 116 extending from rear faceplate surface 118. Preferably, assembly 10 is secured to faceplate 100 via suitable fasteners such as, for example, screws 120 extending through flange 112 into upper body 14.

Figure 6:
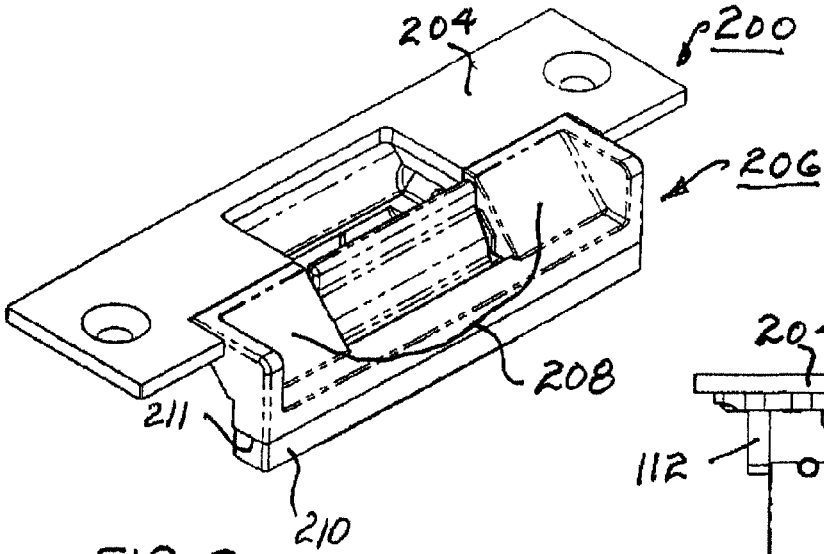
FIG. 6 is an isometric view like that shown in FIG. 3, showing use of an alternative embodiment of a faceplate.
Figure 7:
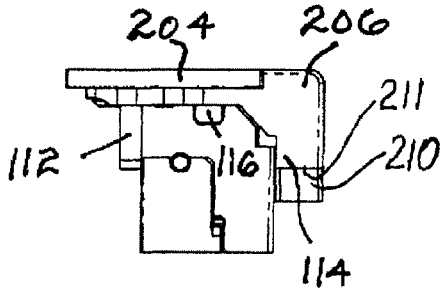
FIG. 7 is an end view of the assembly shown in FIG. 6.

Referring now to FIGS. 6 and 7, an alternative strike faceplate arrangement 200 is shown, comprising a planar first faceplate element 204 mated to a second formed faceplate element 206 including deadlatch ramps 208 for mortise style locksets, flanges 112,114, and keys 116. Note that when alternate strike faceplate arrangement 200 is used to replace a larger, existing strike arrangement disposed in an already formed frame pocket, extension 210 may be attachably fitted to a bottom edge 211 of element 206 to completely fill out the formed pocket in the frame. Extension 210 may be press-fitted to the bottom edge such as, for example, via one or more pegs formed in one of element 206 and extension 210 (not shown) received in one or more close-fitting bores formed in the other of element 206 and extension 210 (not shown).

Figure 8:
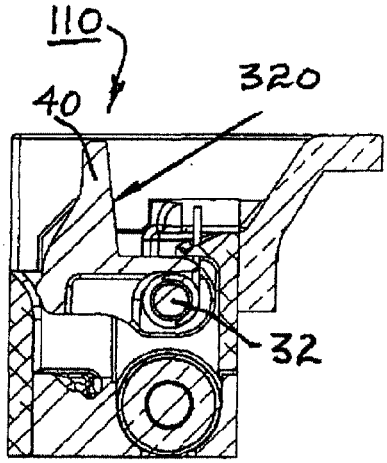
FIG. 8 is a cross-sectional view taken along plane 8-8 in FIG. 3, showing where torsional force is exerted on the assembly shown in FIG. 3.
Figure 9:
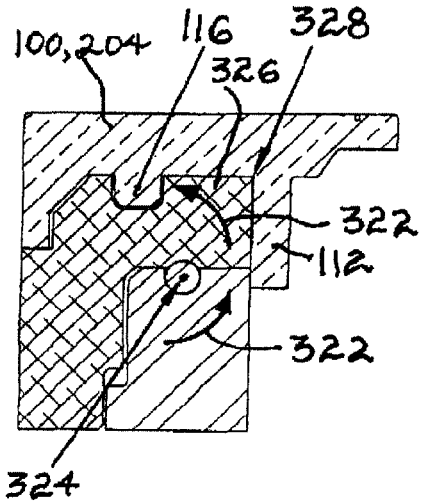
FIG. 9 is a cross-sectional view taken along plane 9-9 in FIG. 3, showing where and how the force shown in FIG. 8 is countered and nullified by interaction of the strike door keeper assembly with the novel faceplate of the present invention.

Referring to FIGS. 8 and 9, in locked mode of system 110, an attempt to forcibly open a door equipped with this system creates a directional force 320 exerted against keeper flange 40 and a resulting torque 322 about the axis 324 of axle 32. In accordance with the present invention, torque 322 is resisted by interaction of keys 116 with flange 326 of upper body 14 (FIGS. 1 and 2), as well as by corner 328 formed between flange 112 and faceplate 100 or 204.

Figure 10:
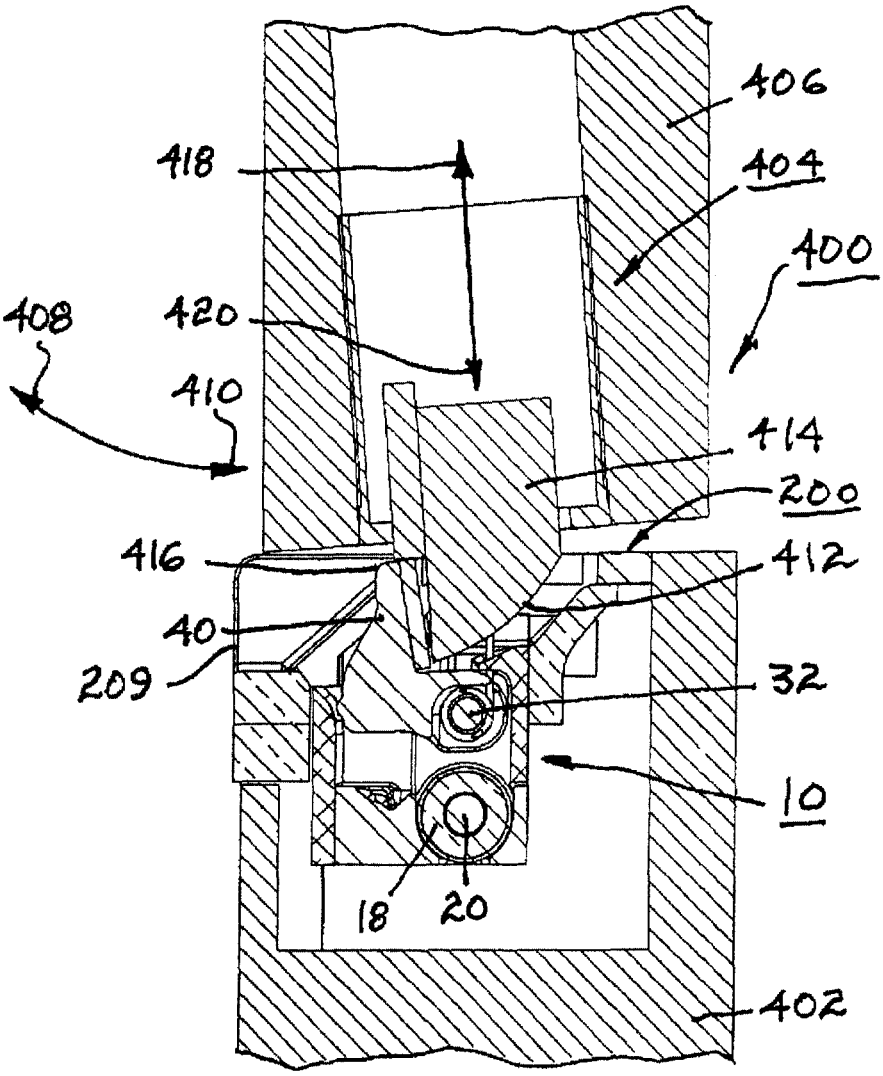
FIG. 10 is a cross-sectional view showing an exemplary releasable security latch assembly incorporating a strike door keeper assembly and novel faceplate assembly in accordance with the present invention.

Referring to FIG. 10, an exemplary releasable security latch assembly 400 incorporates an electric strike door keeper assembly 10 and novel strike faceplate 200 in accordance with the present invention. The door latch assembly and strike faceplate are shown mounted in a doorjamb or frame 402, with a complementary spring-loaded latch bolt assembly 404 mounted in a door 406 that pivotably opens and closes in respective directions 408,410. The respective mounting positions of the electric strike door keeper assembly 10 and the latch bolt assembly 404 may be reversed, to equal effect.

In operation, beginning with door 406 open, as door 406 closes in direction 410, the tapered or curved face 412 of latch bolt 414 passes through striker lip 209 and engages the outer end 416 of keeper flange 40. Continued closing force on door 406 causes latch bolt 414 to be forced into door 406 in direction 418 until the tip of latch bolt 414 clears end 416 of keeper flange 40. A spring (not shown) in assembly 404 causes latch bolt 414 to return in reciprocal direction 420 until latch bolt 414 is resident behind keeper flange 40. In this locked position, releasable security latch assembly 400 cannot be opened without either electrical release of electric strike door keeper assembly 10 or destruction of one or more components of assembly 400 or the door or frame.

To release security latch assembly 400, solenoid 18 is energized, causing armature 20 and blocker 22 to be withdrawn from rotational interference with locking tang 66 (FIGS. 1,2) as described above. In response to a door-opening force 320 (FIG. 8) against keeper flange 40, keeper flange 40 progressively rotates counterclockwise on axle 32. As door 406 begins to swing in opening direction 408, latch bolt 414 moves along the inner surface of keeper flange 40 until the tip of the latch bolt clears the keeper flange. Latch bolt 414 then is swung by door 406 in direction 408 through striker lip 209, completing the unlocking process. No retraction of latch bolt 414 into door 406 is required during unlocking of assembly 400.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A strike door keeper assembly, comprising:

a) first and second interlocking bodies matable to form an assembly body, each of said first and second interlocking bodies defining a journal bearing;

b) a keeper subassembly disposed within said assembly body, said keeper subassembly including an axle, a keeper flange, and a locking tang; and c) an actuating member disposed within said assembly body, said actuating member terminating in a blocker, said blocker having a first position and a second position, wherein each of said journal bearings defined in said first and second interlocking bodies are configured for receiving said axle, wherein said axle is journaled in said journal bearings, said keeper flange is pivotable on an axis of said axle and protrudes through an opening in one of said first and second interlocking bodies, and said locking tang extends into interfering relationship with said blocker to fix said keeper flange in a locking position when said blocker is in one of said first and second positions, wherein mating edges of each of said first and second interlocking bodies have mating surfaces facing in x, y, and z directions such that said first and second interlocking bodies nest together and mutually lock against relative motion therebetween in said x, y and z directions, and wherein said x direction is parallel to said axis of said keeper flange about said axle, each of said y and z directions are perpendicular to said x direction, and said y direction is perpendicular to said z direction.

2. A strike door keeper assembly in accordance with claim 1 wherein said actuating member is an electric solenoid.

3. A strike door keeper assembly in accordance with claim 1 further comprising a bias spring disposed between said keeper subassembly and one of said first and second interlocking bodies to urge said keeper subassembly toward said locking position.

4. A strike door keeper assembly in accordance with claim 1 including a faceplate having a planar faceplate element, wherein said faceplate is separate from said assembly body.

5. A strike door keeper assembly in accordance with claim 4 wherein said faceplate includes a first flange extending from said planar faceplate element as a mounting flange for said strike door keeper assembly.

6. A strike door keeper assembly in accordance with claim 5 wherein said faceplate includes a second flange extending from said planar faceplate element and offspaced from said first flange for capturing said strike door keeper assembly therebetween.

7. A strike door keeper assembly in accordance with claim 5 wherein said faceplate includes at least one key extending from said planar faceplate element for engaging a flange formed in one of said first and second bodies.

8. A strike door keeper assembly in accordance with claim 1 wherein each of said journal bearings defined in said first and second interlocking bodies is a half-journal bearing.

9. A releasable security latch assembly for releasably latching a door to a frame, comprising:

a) a strike door keeper assembly;

b) a faceplate supportive of said strike door keeper assembly and mounted to one of said door and frame; and c) a latch bolt assembly mounted to the other of said door and frame for engaging said strike door keeper assembly, wherein said strike door keeper assembly includes:

i) first and second interlocking bodies matable to form an assembly body, each of said first and second interlocking bodies defining a journal bearing, ii) a keeper subassembly disposed within said assembly body, said keeper subassembly including an axle, a keeper flange, and a locking tang, and iii) an actuating member disposed within said assembly body, said actuating member terminating in a blocker, wherein each of said journal bearings defined in said first and second interlocking bodies are configured for receiving said axle, wherein said axle is journaled in said journal bearings, said keeper flange is pivotable on an axis of said axle and protrudes through an opening in one of said first and second interlocking bodies to engage said latch bolt assembly, and said locking tang extends into interfering relationship with said blocker to fix said keeper flange in a locking position when said blocker is in one of a first position and a second position, wherein mating edges of each of said first and second interlocking bodies have mating surfaces facing in x, y, and z directions such that said first and second interlocking bodies nest together and mutually lock against relative motion therebetween in x, y and z directions, and wherein said x direction is parallel to said axis of said keeper flange about said axle, each of said y and z directions are perpendicular to said x direction, and said y direction is perpendicular to said z direction.

10. A releasable security latch assembly in accordance with claim 9 further including an extension attachably fitted to said faceplate wherein said extension fills out a pocket formed in said one of said door and frame for receiving said faceplate.

11. A releasable security latch assembly in accordance with claim 9 wherein each of said journal bearings defined in said first and second interlocking bodies is a half-journal bearing.

* * * * *